US007357000B2

(12) United States Patent
Schwichtenberg et al.

(10) Patent No.: US 7,357,000 B2
(45) Date of Patent: Apr. 15, 2008

(54) DISPLAY DECK FOR A TEMPERATURE CONTROLLED CASE

(75) Inventors: Bradley R. Schwichtenberg, Midlothian, VA (US); J. Keith Norton, Richmond, VA (US); Dale D. Stevens, Des Moines, IA (US); Peter F. Sosso, Mason City, IA (US)

(73) Assignee: Dover Systems, Inc., Duluth, GA (US)

( * ) Notice: Subject to any disclaimer, the term of this patent is extended or adjusted under 35 U.S.C. 154(b) by 325 days.

(21) Appl. No.: 11/002,013

(22) Filed: Nov. 30, 2004

(65) Prior Publication Data

US 2005/0136160 A1 Jun. 23, 2005

Related U.S. Application Data

(60) Provisional application No. 60/527,140, filed on Dec. 5, 2003.

(51) Int. Cl.
*A47F 3/04* (2006.01)

(52) U.S. Cl. ..... 62/255; 62/434

(58) Field of Classification Search ..... 62/246–256, 62/430–439

See application file for complete search history.

(56) References Cited

U.S. PATENT DOCUMENTS

| | | | |
|---|---|---|---|
| 570,972 | A | 11/1896 | Wallis |
| 1,594,653 | A | 8/1926 | Anstey |
| D83,798 | S | 3/1931 | Gibson |
| 1,896,693 | A | 2/1933 | Battista |
| 2,105,566 | A | 1/1938 | Waunch |
| 2,136,232 | A | 11/1938 | Brochmann, Jr. |
| 2,181,635 | A | 11/1939 | Tull |
| 2,181,636 | A | 11/1939 | Saunders |
| 2,181,637 | A | 11/1939 | Ardito |
| 2,209,690 | A | 7/1940 | Fraser |
| 2,214,239 | A | 9/1940 | Young |
| 2,279,484 | A | 4/1942 | Munshower |
| 2,282,342 | A | 5/1942 | Preble |
| D133,699 | S | 9/1942 | Everett et al. |
| D135,095 | S | 2/1943 | Garratt |
| 2,382,599 | A | 8/1945 | Blair |
| D147,231 | S | 8/1947 | Everett |
| 2,425,473 | A | 8/1947 | Hoffman |
| D149,910 | S | 6/1948 | Schuster |
| 2,663,159 | A | 12/1953 | Ullstrand |
| 2,732,689 | A | 1/1956 | Shreve |
| 2,962,874 | A | 12/1960 | Fitzgerald |
| 2,973,631 | A | 3/1961 | Adkins |
| 3,056,274 | A | 10/1962 | Pouchert |
| 3,368,784 | A | 2/1968 | Peterson |
| 3,463,433 | A | 8/1969 | Stein et al. |
| 3,730,603 | A | 5/1973 | Looms |
| 3,850,486 | A | 11/1974 | Saxe |

(Continued)

*Primary Examiner*—William E. Tapolcai
(74) *Attorney, Agent, or Firm*—Foley & Lardner LLP

(57) ABSTRACT

A temperature controlled case defines a space for storage of products and includes a cooling system to circulate a fluid to maintain a temperature of the products in the space. A deck is provided within the space and has a stepped configuration to provide multiple product support surfaces configured to support the products. At least one cooling element is coupled to the deck and receives a coolant from the cooling system so that the product support surfaces provide contact cooling to the products.

16 Claims, 8 Drawing Sheets

U.S. PATENT DOCUMENTS 4,008,873 A 2/1977 Travaglio et al.
4,108,085 A 8/1978 Shepherd et al.
4,189,928 A 2/1980 Cerny
4,280,335 A 7/1981 Perez et al.
D260,208 S 8/1981 Nutting
4,306,616 A 12/1981 Woods, Jr. et al.
4,307,671 A 12/1981 Albano
4,421,289 A 12/1983 Sturm
4,523,439 A 6/1985 Denisot
4,934,645 A 6/1990 Breslow
4,984,435 A 1/1991 Seino et al.
5,154,388 A 10/1992 Magaro
5,199,579 A 4/1993 Van Duyne
5,357,767 A 10/1994 Roberts
5,381,670 A 1/1995 Tippmann et al.
D356,454 S 3/1995 Harris
5,452,875 A 9/1995 Kern
5,502,979 A 4/1996 Renard
5,531,159 A 7/1996 Stubblefield
5,606,863 A 3/1997 Kicklighter et al.
5,626,028 A 5/1997 Graat et al.
D390,380 S 2/1998 Furnell
5,735,131 A 4/1998 Lambright, Jr. et al.
5,738,019 A 4/1998 Parker
5,755,108 A 5/1998 Ibrahim et al.
5,772,113 A * 6/1998 Gerstmann et al. ..... 237/8 R
5,816,051 A 10/1998 Hall et al.
5,921,096 A 7/1999 Warren
5,931,018 A 8/1999 Hall et al.
5,964,512 A 10/1999 Borgen
5,970,734 A 10/1999 Stillwell et al.
6,164,461 A 12/2000 Ward et al.
6,182,459 B1 2/2001 Hertel
6,185,951 B1 2/2001 Lane et al.
6,220,461 B1 4/2001 Dickinson
6,273,276 B1 8/2001 Upton et al.
6,379,240 B2 4/2002 Livchak et al.
6,389,993 B1 5/2002 Ondrasik
6,412,296 B1 7/2002 Rossi
6,418,748 B1 * 7/2002 Kramer ..... 62/434
6,505,547 B1 1/2003 Burnett et al.
6,519,962 B1 2/2003 Schuetter
6,641,098 B1 11/2003 Proffitt
6,701,735 B1 3/2004 Daddis, Jr. et al.
6,769,476 B2 8/2004 Schulz et al.
6,827,463 B2 12/2004 Chuang et al.
2003/0230095 A1 12/2003 Kahler

* cited by examiner

FIGURE 1B
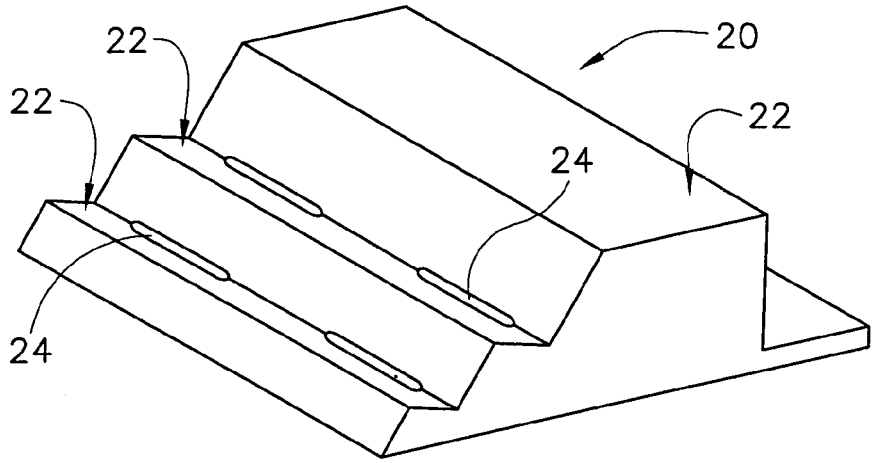
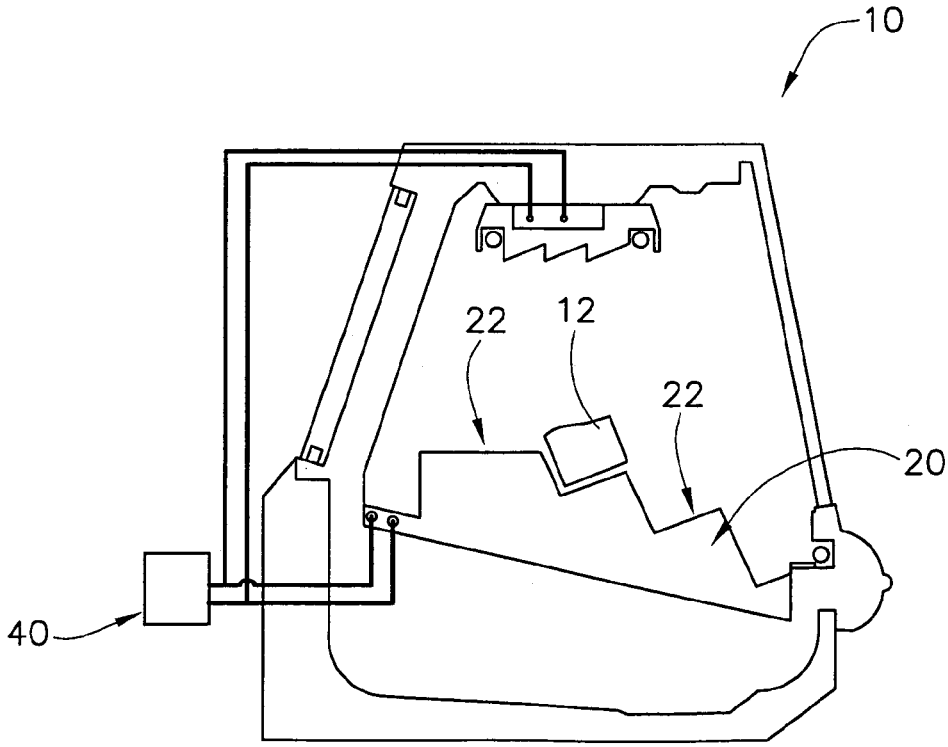
FIGURE 2A

FIGURE 2B
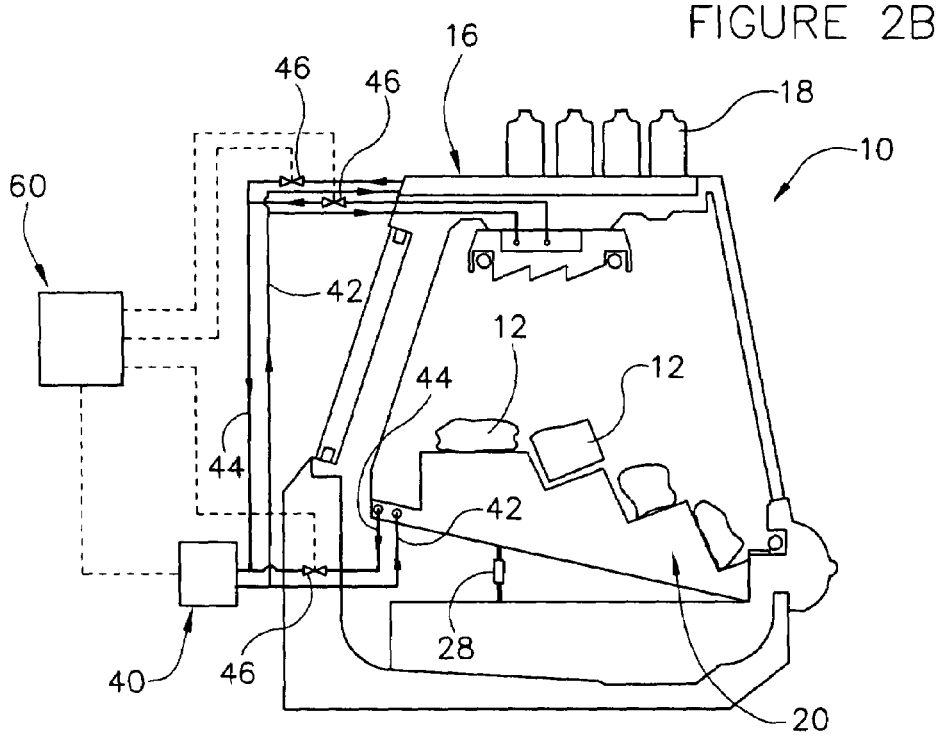
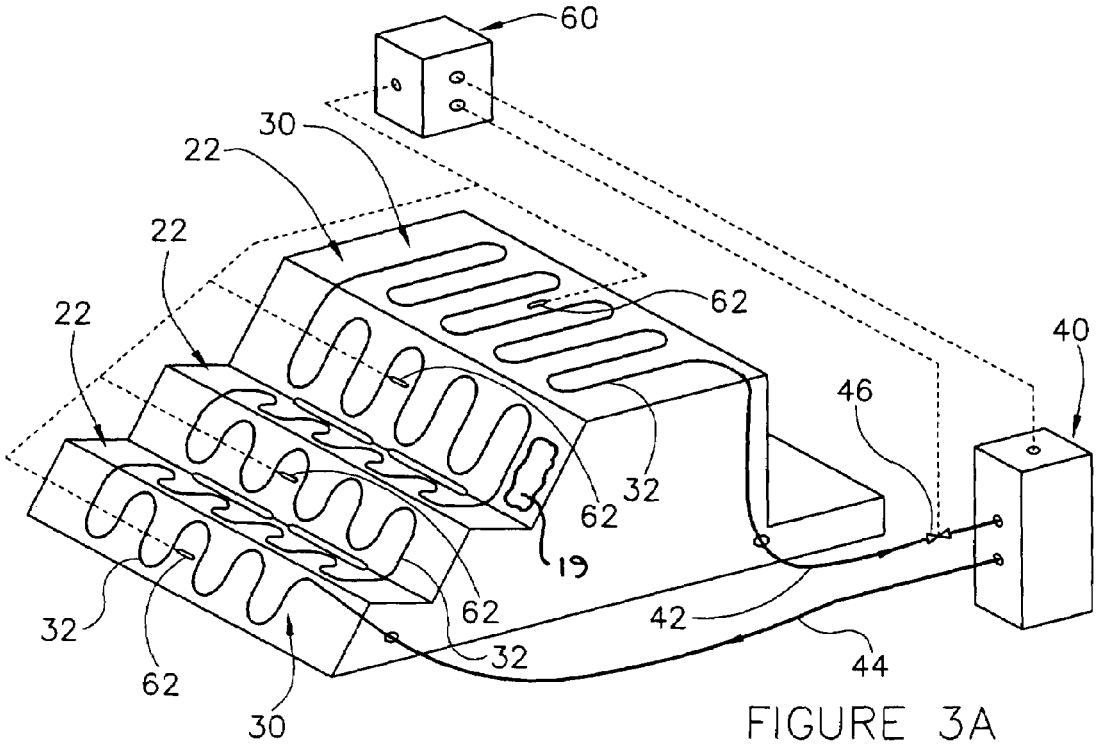
FIGURE 3A

FIGURE 3B
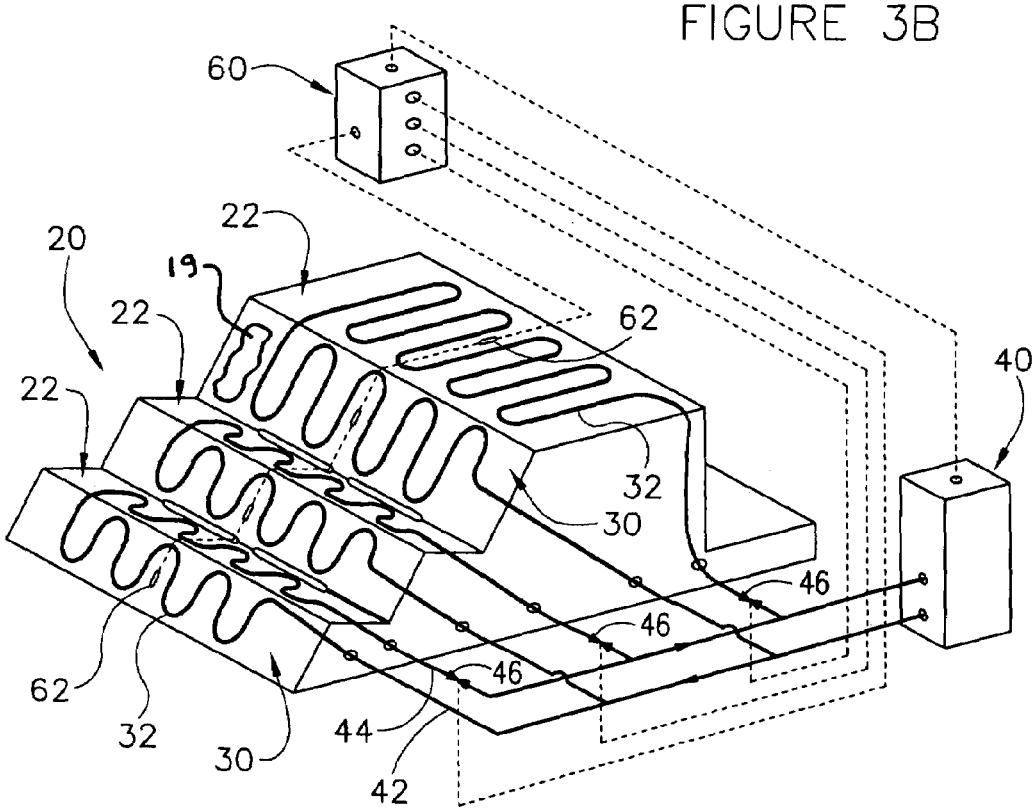
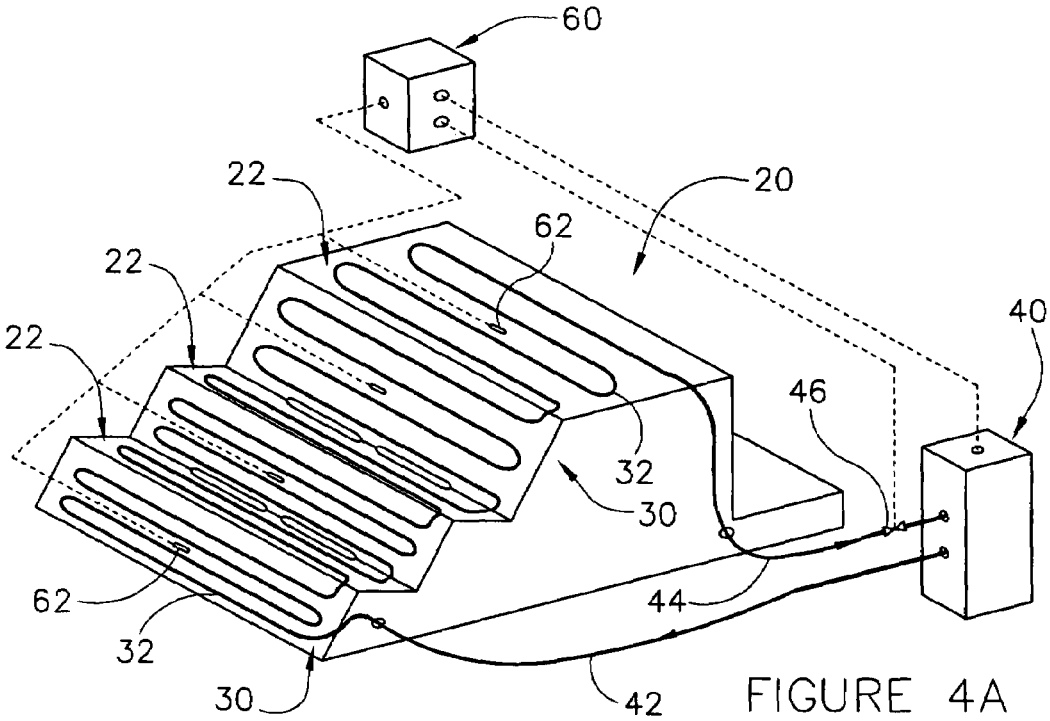
FIGURE 4A

FIGURE 5B
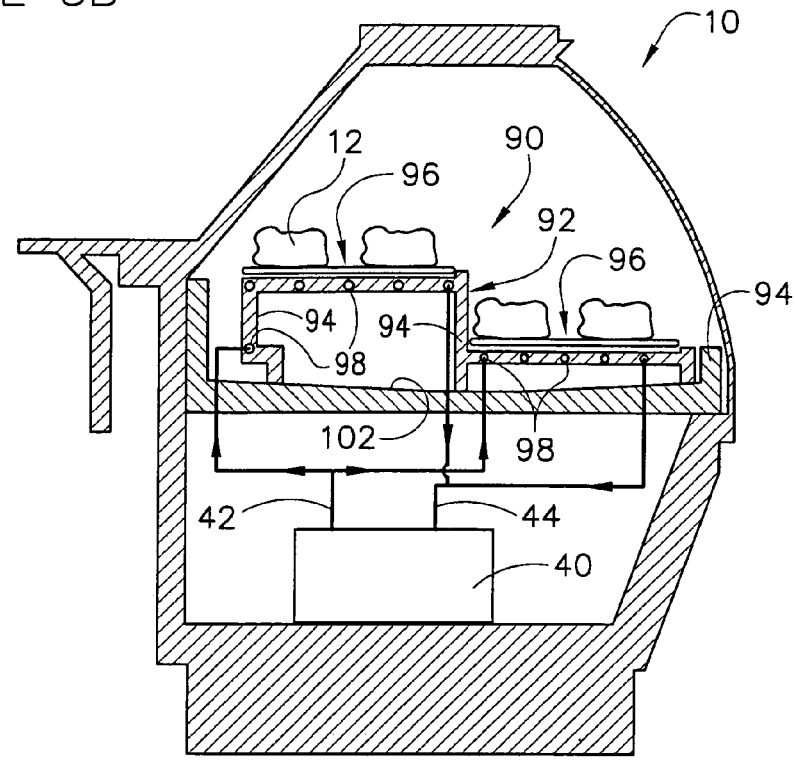
FIGURE 6A
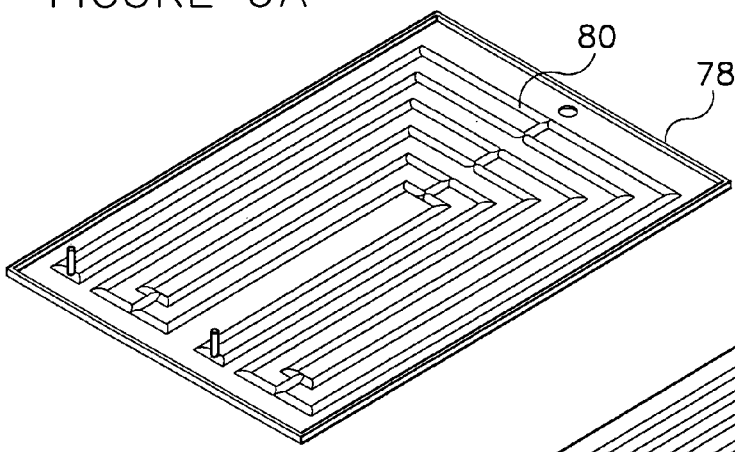
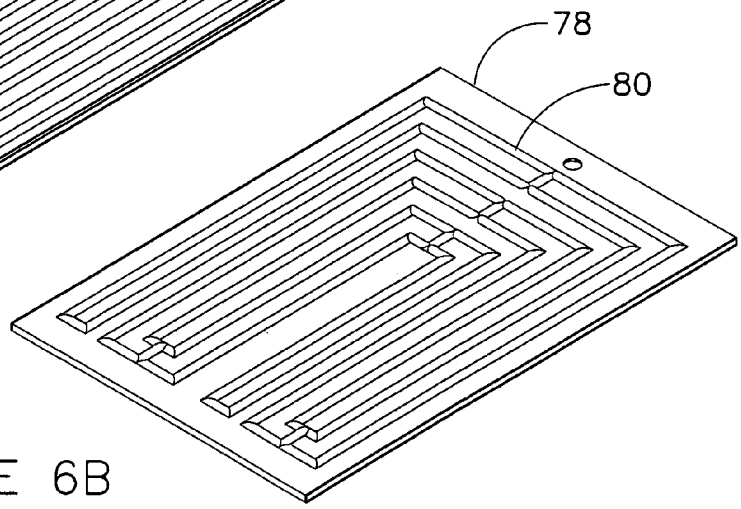
FIGURE 6B

DISPLAY DECK FOR A TEMPERATURE CONTROLLED CASE

CROSS REFERENCE TO RELATED APPLICATIONS

The present Application claims the benefit of priority, as available under 35 U.S.C. § 119(e)(1), to U.S. Provisional Patent Application No. 60/527,140 titled "Display Deck for a Temperature Controlled Case" filed on Dec. 5, 2003 (which is incorporated by reference in its entirety).

FIELD

The present inventions relate to a display deck for use in a temperature controlled case. The present inventions relate more particularly to a display deck having multiple product support surfaces configured to provide contact cooling to products within the temperature controlled case. The present inventions relate more particularly to a display deck having multiple product support surfaces configured at various angles and/or elevations.

BACKGROUND

It is generally known to provide for display surfaces to support products (e.g. decks, pans, etc.) for use in a temperature controlled case. Such display surfaces are typically flat or planar and may be provided in one or more segments. Such display surfaces may also be configured for circulation of a coolant through the segments to provide cooling to products within the temperature controlled case. However, such known display surfaces typically do not realize certain advantageous features (and/or combinations of features). For example, it would be desirable to provide a display deck for a temperature controlled case that includes any one or more of the following advantageous features:

1. An increased amount of surface area to support products, relative to a conventional flat deck.
2. Multiple product support surfaces configured to display the products to a user and to provide contact cooling of the products.
3. A cooling system configured to circulate a coolant to the product support surfaces so that the product support surfaces may provide contact cooling to the products.
4. An insulation layer to provide improved thermal performance and to reduce accumulation of moisture and condensation.
5. A cover layer that can be aesthetically and/or functionally coordinated with some or all of the design elements of the temperature controlled case.
6. A generally planar deck that is configurable as multiple shelves (e.g. "mezzanine shelves," etc.) within the temperature controlled case.
7. A fluid heating system to provide heated or warmed fluid for circulation to the product support surfaces to provide contact warming of the products.
8. A frame configured to provide "steps" having multiple levels of generally planar pans to provide a multi-tiered display surface.
9. Increased surface area of the product support surfaces provided by an angular (e.g. slanted, etc.) orientation of one or more of the product support surfaces.
10. Multiple product support surfaces that can be provided in a variety of different orientations (e.g. planar, curved, non-planar, slanted, horizontal, etc.) within the display deck.

SUMMARY

According to one embodiment, a temperature controlled case defines a space for storage of products and includes a cooling system configured to circulate a coolant to maintain a temperature of the products in the space. A deck is positioned within the space and has a stepped configuration to provide multiple product support surfaces configured to support the products. At least one cooling element is coupled to the deck and receives a coolant from the cooling system so that the product support surfaces provide contact cooling to the products.

According to another embodiment, a temperature controlled case defines a space for storage of products, and includes a system to circulate a fluid to maintain a temperature of the products in the space. A deck having tiers formed by a plurality of separate product support surfaces is supported on a frame member positioned within the space. One of the product support surfaces and the frame member is integrated with the cooling system so that the product support surfaces provide contact cooling to the products displayed at different elevations.

According to another embodiment, a temperature controlled case defines a space for storage of products and includes a cooling system to circulate a fluid to maintain a temperature of the products in the space. Multiple product support surfaces are coupled to the case and stacked in a generally vertical orientation within the space. A cooling element is associated with the product support surfaces to receive a heat transfer fluid from the cooling system so that the product support surfaces provide contact cooling to the products.

According to a further embodiment, an apparatus for the display of temperature controlled products includes a case defining an enclosure. A sheet having a plurality of contiguous stepwise surfaces is located within the space A cooling element is integrated with at least one of the stepwise surfaces and configured to facilitate conductive heat transfer with the products. A cooling system circulates a coolant to the cooling element, and a control system configured to regulate a flow of coolant to the cooling element to maintain a desired temperature of the products.

According to a further embodiment, a temperature controlled apparatus for display of food products includes a display deck having product support surfaces that receive the food products and maintain a temperature of the products within a predetermined range. A fluid delivery system circulates a fluid in at least one of a chilled state and a heated state, and in thermal communication with the product control surfaces. A control system regulates a temperature of the product support surfaces, which have an appearance indicative of a type of food product displayed thereon.

According to a further embodiment, a temperature controlled apparatus for display of food products includes a display deck having one product support surface to receive heated food products and another product support surface to receive chilled food products. A fluid delivery system circulates a fluid in a heated state to the first product control surface and in a chilled state to the second product control surface. A control system regulates a temperature of the first and second product support surfaces.

BRIEF DESCRIPTION OF THE DRAWINGS

FIG. 1B is a schematic image of a perspective view of a display deck for a temperature controlled case according to the embodiment of FIG. 1A.

FIG. 2A is a schematic image of a side view of a display deck and temperature controlled case according to an exemplary embodiment.

FIG. 2B is a schematic image of a side view of a display deck and temperature controlled case according to another exemplary embodiment.

FIG. 3A-3B are schematic diagrams of a display deck with cooling elements according to an exemplary embodiment.

FIG. 4A-4B are schematic diagrams of a display deck with cooling elements according to another exemplary embodiment.

FIG. 5B is a schematic diagram of a cross sectional view of a display deck and a temperature controlled case according to another exemplary embodiment.

FIG. 6A is a schematic diagram of a bottom perspective view of a display deck according to an exemplary embodiment.

FIG. 6B is a schematic diagram of a top perspective view of a display deck according to the embodiment of FIG. 6A.

DETAILED DESCRIPTION

Figure 1A:
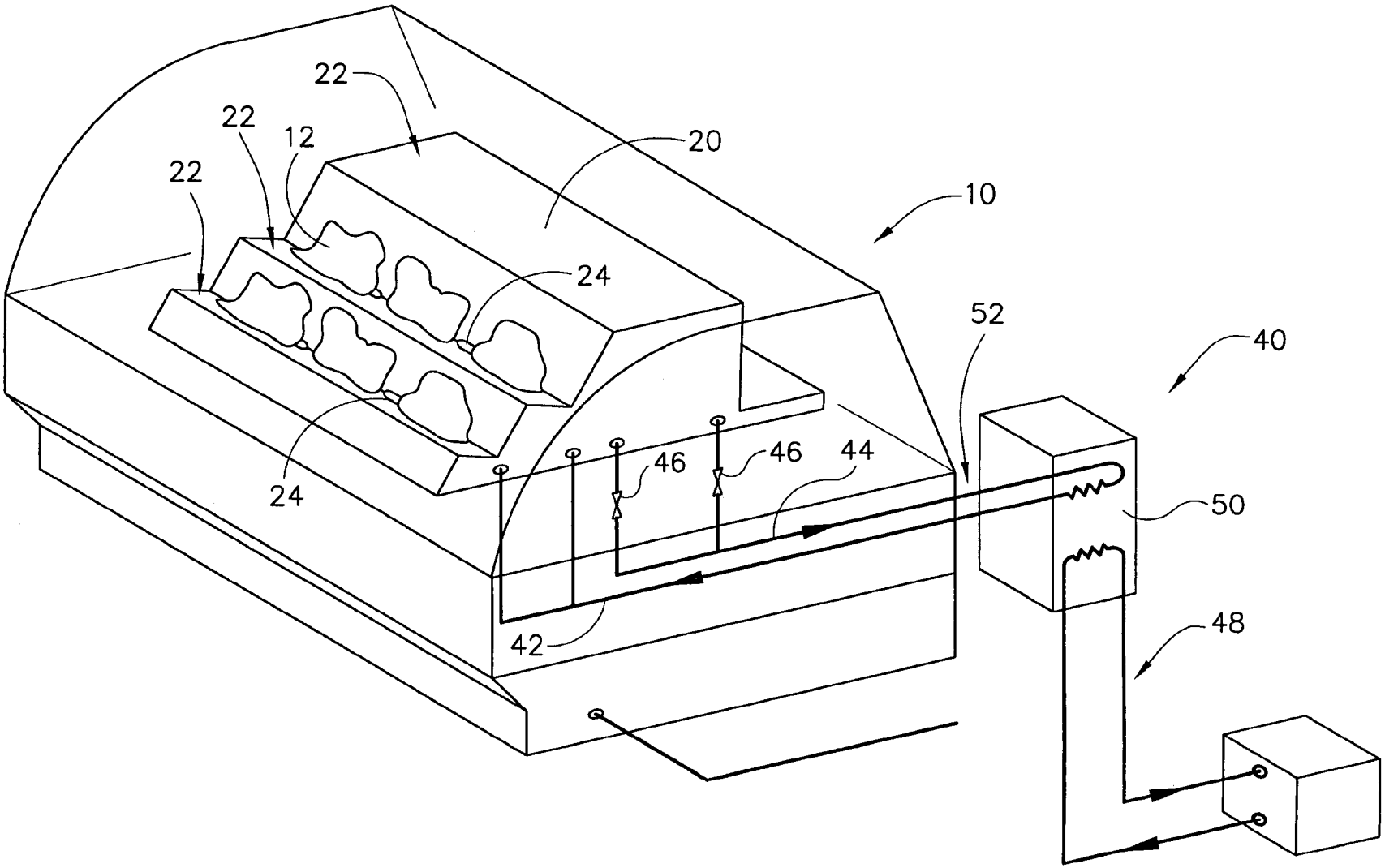
FIG. 1A is a schematic image of a perspective view of a display deck and a temperature controlled case according to an exemplary embodiment.
Figure 4B:
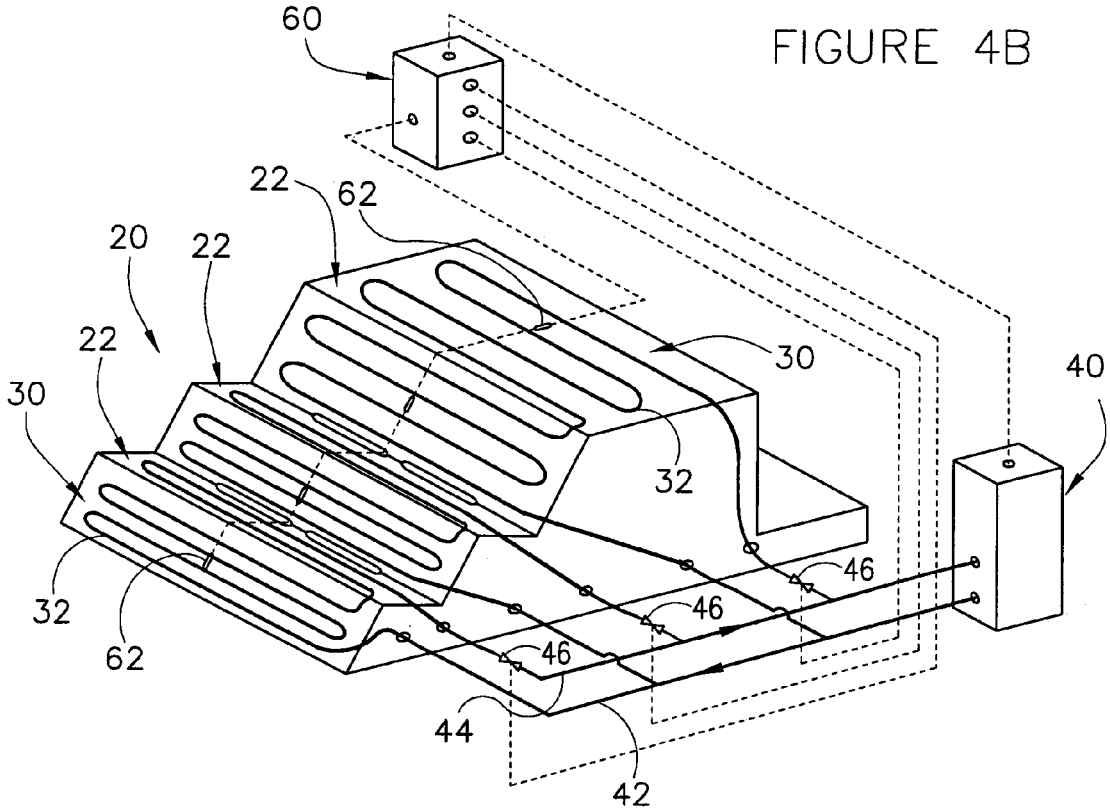

Referring to the FIGURES, various embodiments of a display deck are disclosed for use in a temperature controlled case or other device for storing or displaying chilled or heated products. Although the disclosure is described in the context of a "refrigerated" display deck configured for use with a chilled coolant in a temperature controlled case (e.g. merchandiser, etc.), the coolant may be warmed to provide a heated or warmed display device (e.g. food service or preparation tables, heated food cases, etc.). According to the illustrated embodiments, the display deck has multiple surfaces intended to increase the capacity for storage and/or display of products within a case, and to provide a cooling (or heating) element formed within, or coupled to, portions of the deck to provide contact cooling to the products placed on the deck.

Referring to FIGS. 1A-2B, the display deck 20 for a temperature controlled case 10 is shown schematically according to one embodiment. Display deck 20 is shown as an integrated structure that provides multiple surfaces (shown as multi-level product support surfaces 22) for displaying products within a case. The surfaces 22 of the display deck are configured to support a wide variety of products 12 (e.g. chilled or heated objects such as food products) and are provided with cooling element(s) 30 (as shown for example in FIGS. 3A-4B) intended to provide "contact" cooling (e.g. conductive cooling, etc.) of the products 12 supported on the surfaces 22. A cooling system 40 provides a source of chilled fluid to the cooling element (s) 30 to maintain a desired temperature of products 12 on surfaces 22. A control system 60 is configured to receive and monitor signals representative of a temperature of the products 12 and/or surfaces 22 and to provide appropriate output signals to cooling system 40 to maintain a desired temperature of the products.

The display deck 20 may be formed or constructed in any suitable configuration for supporting and displaying products 12. For example, display deck 20 may be formed from a single sheet or multiple sheets into a shape or configuration with single or multiple steps (e.g. tiered, terraced, staggered ridges/valleys, waves, etc.), and various or multiple slopes, slants or angles, etc. (see for example, FIGS. 1A-4B). The display deck 20 is intended to increase the available surface area through which contact cooling of products 12 may be provided within the case. According to a preferred embodiment, the sheet for display deck 20 may be formed from a heat-conducting material such as a metallic material (e.g. steel, aluminum, copper, etc.), however the display deck may be formed from other suitable materials such as plastic, glass, ceramic, etc. Apertures (shown for example as slots 24 in FIGS. 1B and 3A-4B) may be included in the sheet at "low" points (e.g. valleys, etc.) and intended to permit liquids (such as condensation, food product liquids, cleaning solution, etc.) to drain through the aperture and prevent accumulation on surfaces 22. The apertures may be configured to permit drainage to a catch containment beneath the sheet, or other suitable drainage collection devices (e.g. troughs, gutters, tubes, etc.—not shown) may be provided for routing the liquids to a suitable repository (e.g. reservoir, floor drain, etc.—not shown).

Referring to FIGS. 3A-3B and 4A-4B, cooling element(s) 30 are shown integrated with the sheet of display deck 20 to provide contact cooling of the products supported on the product support surface(s) 22. The cooling element(s) 30 are designed to maintain the desired temperature of the products 12 supported on the surfaces 22. The cooling element(s) 30 may be provided internal to the sheet (e.g. internal passages, flow paths, channels, etc.—similar to those shown in FIGS. 6A-6B for example) or external (e.g. attached cooling coils, fins, etc.). According to one embodiment, the cooling element(s) may be one or more coils 32 (shown schematically for example in FIGS. 3A-4B as a pattern of tubing for circulating a heat transfer fluid) attached to a back side of the sheet of display deck 20 for circulation of the heat transfer fluid (e.g. volatile refrigerant, secondary liquid coolant, etc.) to provide contact cooling to the products 12 supported on the product support surface(s) 22.

The coil(s) 32 of cooling element(s) 30 may include fins or other structure (not shown) to promote and/or distribute heat transfer and the coil(s) 32 may be attached to a back surface of the sheet in a suitable manner (e.g. by a thermal conducting paste, gel, or other substance, welding, brazing, brackets, clips, etc.) to promote contact cooling of the products through the sheet. The cooling element(s) may also be provided in modular form and configured for attachment at any suitable location on the backside of the sheet (e.g. by flexible hose connections, articulating joints, releasable clips, etc.—not shown). The cooling element(s) are intended to be positioned on the sheet corresponding to the location of the surfaces for supporting the products so that the cooling element(s) provide contact cooling through the sheet to the products. In applications involving multiple cooling elements, the cooling elements may be configured in a series flow arrangement (shown for example in FIGS. 3A and 4A) or a parallel flow arrangement (shown for example in FIGS. 3B and 4B).

A layer of insulating material (not shown) may be provided over the back of the sheet and/or the cooling element (s) and may be a blanket, molded or foamed insulation layer.

A layer of a cover material may be provided over the layer of insulation material to provide an attractive and water resistant surface. The layers of insulation material and cover material are intended to prevent liquids such as water (e.g. moisture, condensation, frost, etc.) from accumulating and/or dripping from the underside of the sheet and to improve the thermal performance of the display deck.

The display deck 20 is generally intended for use as a multi-level or multi-surface display structure within an internal portion of a case. However, a top surface of the case may be provided with a panel 16, such as a generally planar (e.g. "flat") panel, with an upper surface that is cooled by cooling elements for storage of other objects 18 (e.g. above or external to the case). For example, the display deck 22 within the case may store products such as cold cuts, pre-made meals, etc. within the case and panel 16 in the top cover of the case may be used as a platform to store/display other products 18 such as beverages (e.g. soda, etc.) that are chilled by direct contact (such as shown for example in FIG. 2B). The cooling element for panel 16 may be supplied with fluid by suitable branch lines from the cooling system 40 and a separate valve 46 may be provided to regulate the temperature of the top panel 16 independently from the display deck 22 within the case.

Referring further to FIG. 2B, the display deck may also be provided with an adjustment member 28 configured to adjust an angle of the display deck to permit a variety of product presentation options. Adjustment member 28 may include threaded members (e.g. jack screw, etc.) or may be a linear actuator, pneumatic cylinder device, hydraulic cylinder device, etc.

Referring further to FIGS. 3A-4B, in an embodiment having cooling element(s) arranged in a series flow arrangement, the portion of the sheet nearest the "inlet" of the fluid may tend to be slightly colder and have relatively low temperature variation than a portion of the sheet nearest the "exit" of the fluid which may have been slightly warmed and may exhibit a greater degree of temperature variation (e.g. due to environmental factors, product loading, etc.). Accordingly, the sheet can be configured to display certain products that have a high sensitivity to temperature variation (e.g. sliced meats, etc.) near the inlet and to display certain objects with less sensitivity to temperature variation (e.g. whole or bulk meat products, etc.) near the outlet.

In an embodiment having a series or parallel flow arrangement for the cooling element(s), a supply header 42 and return header 44 are provided to circulate a fluid from cooling system 40 through the cooling elements 30. A flow regulating or control device such as a valve 46 (such as a balance valve, etc.) may be provided at the outlet of each cooling element 30 to regulate the flow rate of fluid through the cooling element and to control the amount of cooling provided at surface 22. A valve may also be provided on the return header after the last cooling element to control the rate of flow of fluid through all of the cooling elements. Alternatively, other types of valves (e.g. "on/off" valve) may be provided to permit intermittent flow (e.g. pulsed, etc.) of fluid through the cooling elements to provide a desired cooling performance for all product support surfaces 22 of the display deck 20, or for "customized" thermal performance for separate product support surfaces. For example, separate product support surfaces may be maintained at different temperatures to suit the particular temperature requirements of different products. Further, the valve may be another type of valve, such as a control valve configured to "modulate" the flow of fluid based on signals representative of the cooling demand on the surfaces 22 (e.g. surface temperature, air temperature, simulated product temperature, etc.) that are provided to the valve from the control system.

According to an alternative embodiment, the cooling element(s) may be integrated within the sheet of the display deck by formation of passages within the sheet that provide a flow path for the fluid to circulate through the sheet. The passages may be one or more individual passages formed in a pattern (as shown for example in FIGS. 6A-6B). According to a further alternative embodiment, the passage may be in the form of a generally "hollow" core (e.g. plenum, sleeve, etc.—such as shown for example in FIG. 7B) within the sheet and having manifolds (e.g. collectors, etc.) at opposite ends of the sheet to facilitate entry and exit of the fluid from the hollow core portion. Structure or devices for directing the flow of the coolant (e.g. "baffles," flow directors, etc.) may be provided within the core to direct the flow of fluid through the core of the sheet.

The fluid from the cooling system may be a liquid coolant (e.g. secondary coolant, etc.) such as a glycol solution, chilled water, etc. The cooling system may have any suitable configuration and include conventional components. For example, a primary cooling system 48 (e.g. circuit, loop, etc.—shown in FIG. 1A) may be provided that circulates a refrigerant for cooling a heat exchanger 50 (such as an evaporator, chiller, etc.). A secondary cooling system 52 (e.g. circuit, loop, etc.) containing the secondary coolant may interface with heat exchanger 50 to chill the coolant for circulation to the cooling elements. The primary and secondary loops may be provided in any particular configuration. For example, the primary loop 48 may be remotely located (e.g. in an "equipment room" or on a roof top, etc.) and the secondary loop 52 may include piping routed from heat exchanger 50 to the location of the case (and potentially to other cases in the facility interconnected in a network (not shown) by the cooling system). By further way of example, the cooling system may be provided within the case as a "self-contained" system where the primary loop and the secondary loop are both located within the case (e.g. within a base portion or "stand" of the case, etc.). The fluid may also be a refrigerant (e.g. primary refrigerant, etc.), for example, a direct expansion refrigerant such as R22 or other suitable refrigerant, provided by a refrigeration system in a single "loop."

The temperature of the product support surface 22 may be controlled by the control system 60 by regulating the rate of flow of the fluid. For example, the rate of the flow of the fluid may be varied (e.g. metered, regulated, etc.) by devices such as valve 46 (e.g. flow control valves, balance valves, metering valves or the like), or may be controlled by providing a flow of the fluid through the cooling element intermittently (e.g. periodically, etc.) by opening and closing (e.g. cycling, pulsing, etc.) valve 46 (e.g. a flow regulating device such as a "shut-off" valve such as solenoid operated valve, etc.). For applications involving a fluid that is a refrigerant, the flow of the fluid may be regulated by a thermostatic expansion valve or the like. A separate valve 46 may be provided for each cooling element so that the product support surfaces may be maintained at different temperatures to facilitate display of products having different storage temperature requirements to be displayed in the same case. The control system 60 may also regulate the flow rate of the fluid by providing a suitable output signal to a flow generating device (such as a pump and variable speed motor or the like).

According to any preferred embodiment, the cooling system 40 includes a supply header 42 for supplying fluid to display deck 20 and a return header 44 for receiving fluid from the display deck. The supply and return headers may be "flexible" (e.g. hoses, tubing, etc.) or "hard-piped" (e.g. copper tubing, PVC tubing, pipes, etc.), or a combination of flexible and hard-piped. The supply and return headers may be provided with fittings (e.g. quick-disconnects fittings, etc.) to permit convenient coupling or interconnection of the headers with cooling system supply and return lines. The supply header and return header may also be provided with branch supply lines having a fitting (e.g. quick-disconnect fittings, spring-clip fittings, hose clamps, etc.) for interconnecting with the cooling element(s) and/or product support surfaces. Other fitting types, such as universal joints, articulating joints, or the like may be provided to facilitate removal of the cooling element(s) or the product support surface(s) (e.g. for cleaning, maintenance, etc.).

Control system 60 is provided to control operation of cooling system 40 by controlling the flow of fluid to regulate the temperature of the products stored on the sheet. Suitable sensors may be provided within the case or integral (or otherwise operably coupled) with the sheet and/or cooling elements(s) to provide input to the control system. For example, one or more temperature sensing devices 62 (e.g. thermocouples, RTDs, etc.) are shown to be provided at suitable location(s) within, or on the top side or underside of the product support surface(s) 22 to provide a signal representative of temperature of the surface to the control system. The control system is configured process the input signal(s) and provide an output signal (e.g. to regulate the position of a valve, regulate the speed of a pump, etc.) when the temperature of the product support surface reaches certain temperature limits or set points. According to a preferred embodiment, a "high" temperature limit is approximately 33 degrees F. and a "low" temperature limit is approximately 30 degrees F., however, other suitable temperature limits or set points may be provided to suit a particular display deck, case, application or facility.

Control system 60 may include a processor such as programmable logic controller or the like for receiving and monitoring input signals, sending output signals, permitting change or adjustment of set points, providing appropriate indications (e.g. alarms, status, temperature, fluid flow rates, mode of operation (such as cooling or defrost), etc.) and to interface with local or remote monitoring equipment or stations.

Control system 60 may also be configured to initiate and terminate a defrost mode of operation. Defrosting of the product support surface(s) 22 and/or cooling element(s) 30 may be accomplished by stopping the flow of fluid for a period of time to allow frost and/or ice to melt (e.g. "time-off"), or energizing electrical heating elements (e.g. wires, etc.—not shown) formed in or located adjacent to the product support surface(s) and/or cooling element(s), or circulating a "warmed" fluid through the cooling elements (such as may be warmed by "hot gas" from the primary loop, etc.) or other suitable method. The defrost mode may be initiated and terminated based on suitable signals received by the control system, or by a timer, or other suitable method.

Figure 5A:
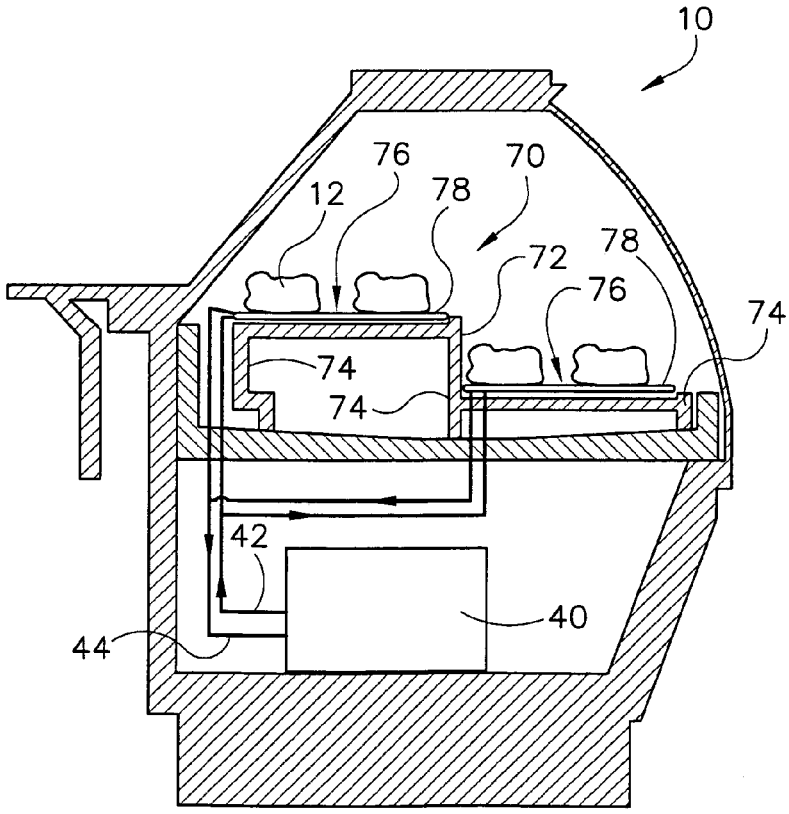
FIG. 5A is a schematic diagram of a cross sectional view of a display deck and a temperature controlled case according to an exemplary embodiment.

Referring to FIG. 5A, a display deck 70 for a temperature controlled case 10 is shown according to another embodiment. Display deck 70 may include a frame member 72 having multiple elevations (e.g. tiers, steps, terraces, platforms, etc.) and having support members 74 configured to support one or more generally planar product support surfaces 76. The product support surface(s) 76 are shown to include one or more pans 78 having an integral cooling element in the form of internal passages 80 for routing a chilled or heated fluid therethrough (as shown, for example, in FIGS. 6A-6B). According to an alternative embodiment, the product support surface(s) may have a separate cooling element coupled to an underside of a sheet for providing contact cooling to products displayed on the surface(s) in a manner similar to that shown and described in relation to FIGS. 3A-3B and 4A-4B. The frame member 72 and support members 74 may be made of a suitable material (such as metal, plastic, etc.) to support the weight of products 12 and is intended to provide a support structure for the pan(s) 78, which may be fixed to the frame member in a substantially permanent manner, or may be removably attached to facilitate removal of the pan(s) for cleaning, maintenance, etc.

Referring to FIG. 5B a display deck 90 for a temperature controlled case 10 is shown according to another embodiment. Display deck 90 is shown to include a frame member 92 having support members 94 for supporting product support surfaces 96. The frame member 92 and support members 94 are shown to be formed as generally (or at least partially) "hollow" structures providing conduits or passages 98 for flow of a heat transfer fluid therethrough to provide cooling to product support surface(s) 100 and products 12. A drip pan 102 (e.g. catch containment, etc.) may be provided to capture fluids such as condensation, food product liquids, etc. The product support surfaces 96 may be provided as relatively thin planar members (e.g. sheets, panels, trays, etc.) formed from a material (e.g. a metallic material, plastic, glass, ceramic, etc.) having desirable heat transfer properties and configured to facilitate contact cooling of products 12 from frame member 92 and support members 94. According to an alternative embodiment, insulation panels may be provided with (or adjacent to) the frame member and support members that are configured to minimize heat transfer from the frame member, support members and/or an underside of the product support surface(s).

Figure 7A:
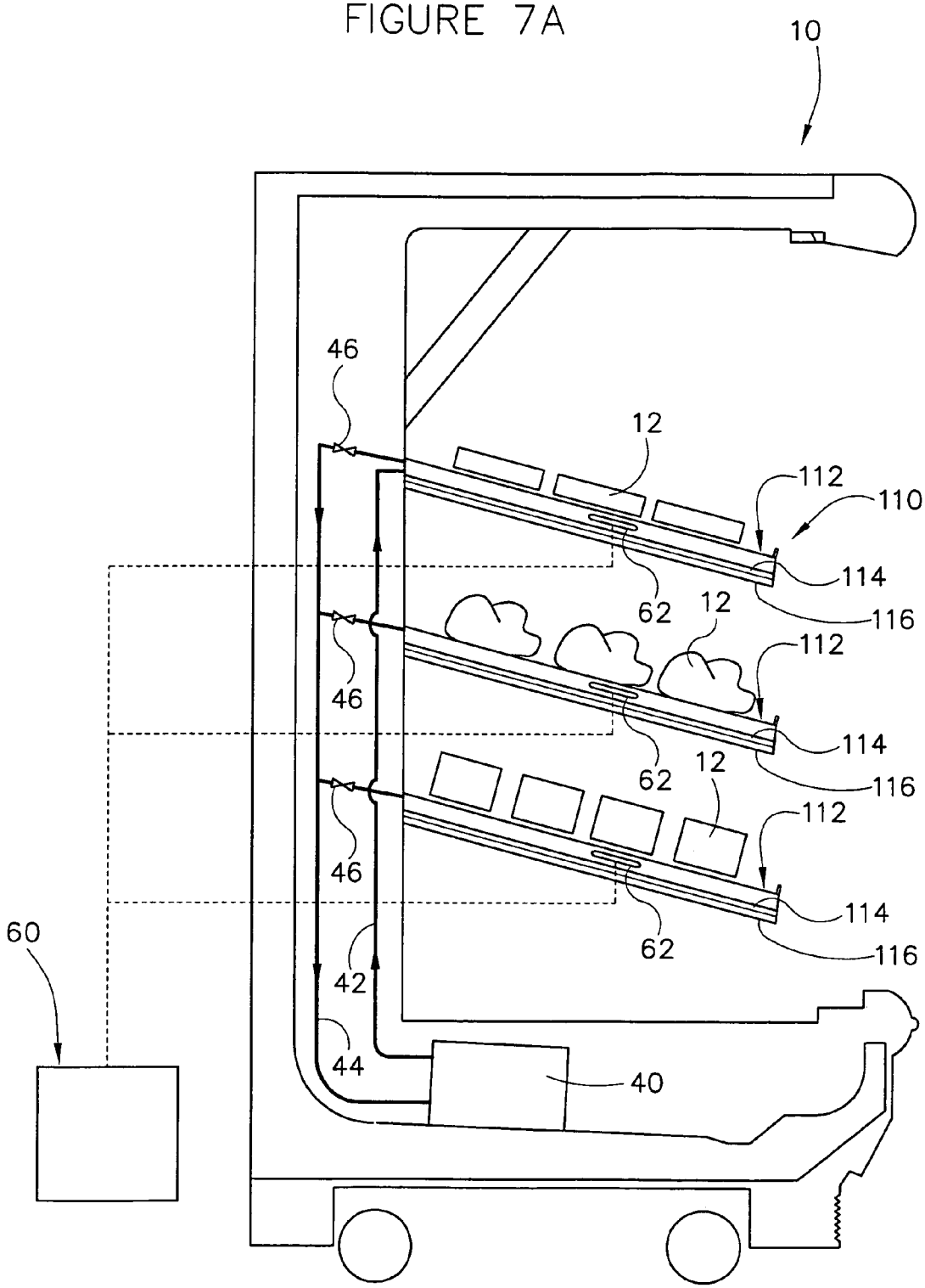
FIG. 7A is a schematic image of a side view of a display deck and temperature controlled case according to an exemplary embodiment.
Figure 7B:
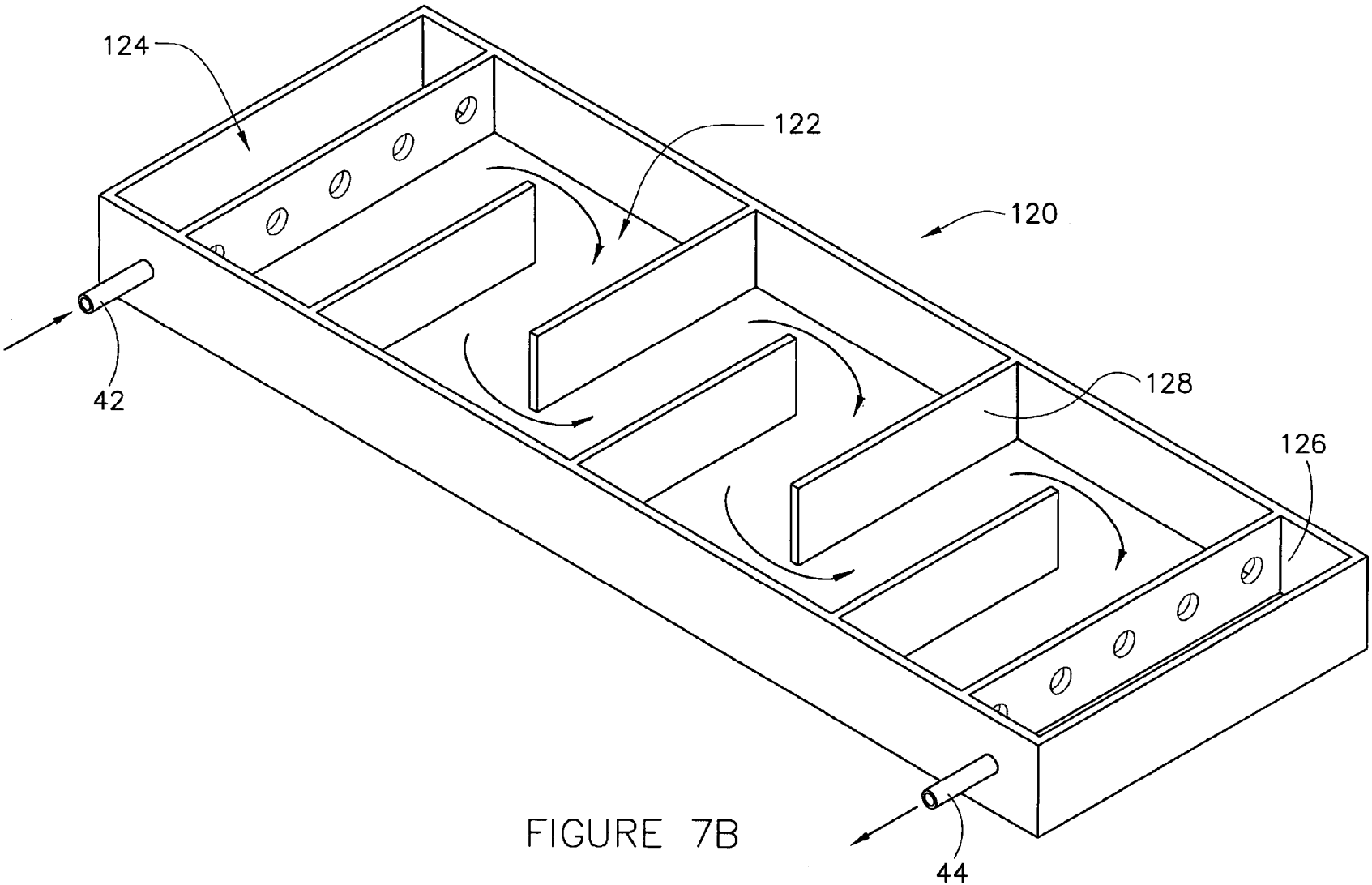
FIG. 7B is a schematic image of a cutaway perspective view of a display deck for a temperature controlled case according to an exemplary embodiment.

Referring to FIG. 7A a display deck 110 for a temperature controlled case 10 is shown according to another embodiment. Display deck 110 is shown to include product support surfaces 112 in the form of generally planar shelf members which may "stacked" in a generally vertical arrangement (e.g. "mezzanine shelves" etc.). The shelf members are configured to provide contact cooling to the products 12 displayed on the product support surfaces 112. A layer of insulation 114 and a cover material layer 116 are shown applied to an underside of the shelf members and are intended to prevent moisture/condensation from an upper shelf member from dripping onto a lower shelf member. Referring further to FIG. 7A, the product support surfaces are shown as "stackable" in a generally vertical orientation and are intended to provide a plurality of "stacked" surfaces configured to provide contact cooling to products stored thereon. The product support surface(s) may have cooling elements attached thereto (in a manner similar to that shown and described in relation to FIGS. 3A-3B and 4A-4B), or may be formed having an internal passage pattern (in a manner similar to that shown in FIGS. 6A-6B) or may be formed as a pan 120 have a generally hollow "flow-through" type core 122 with a supply manifold 124, a return manifold 126 and baffles 128 (as shown schematically for example in FIG. 7B). The internal passages (such as shown in FIGS. 6A-6B may be provided in any suitable configuration or pattern to optimize product merchandising or manufacturing of the display deck. The fluid may be circulated through the cooling elements by headers in a series or parallel configuration by suitable piping (e.g. supply and return headers, branch lines, etc.) and may be provided with a flexible or hard-piped tubing configuration with appropriate fittings such as quick-disconnects to facilitate repositioning the shelves within the case for cleaning, etc.) or adjusting the vertical height or spacing of the surfaces, or adjusting the angle of the surfaces (e.g. for improved product presentation, etc.).

According to other embodiments, the heat transfer fluid may be heated by a suitable device (e.g. electric immersion heater, heat exchange with hot gas from a refrigeration system, etc.) to provide heating to heating elements associated with the product support surface(s). According to further embodiments, the stepped configuration of the display deck lends itself to application of surface treatments intended to aesthetically compliment other features as part of an overall product display or marketing strategy. For example, certain images (e.g. agricultural images for produce products, farm images for meat or dairy products, seascape images for seafood products, etc.) may be superimposed on, embossed on, formed in or applied on the product support surfaces. The product support surfaces may also be provided with an appropriate color, texture or finish to compliment the facility or other portions of the case. The images may be provided (for example) as thin appliques 19 (e.g. foils, films, etc. —shown for example in FIGS. 3A and 3B) that do not appreciably impede the contact cooling of the products, so that the appearance of the product support surfaces may be changed from time to time to support varying themes (e.g. sporting events, holidays, advertising, product promotion or information, community events, etc.). According to other alternative embodiments, the product support surfaces may be formed in shapes intended to be indicative of a particular type of product. For example, a product support surface for seafood products may be formed in the shape of a fish, a product support surface for beef or dairy products may be formed in the shape of an animal such as a cow, a product support surface for produce may be formed in the shape of a basket, etc.

According to other embodiments, multiple cases may be arranged in a symbiotic relationship. For example, "cold" cases and "warm" cases may be configured side-by-side (or in another suitable relationship) so that waste heat from a refrigeration system of the cold case may be used to warm the fluid in the warm case, and so that heat from the warm case may be used to defrost cooled surfaces in the cold case. In other alternative embodiments, cooling elements such as coils may be provided in other locations within the case, such as along end panels to reduce warming of the case from exterior temperature influences. According to further alternative embodiments, a single case may be configured with both heated and cooled product support surfaces. For example, a product support surfaces for heated entrees may be arranged adjacent to a product support surface for chilled items, such as appetizers, salads, side dishes, beverages, etc. According to another example, such a display deck may take a form similar to that shown in FIGS. 4A and 4B where one product support surface may be heated and another product support surface may be chilled. Such a display deck may also take a form similar to that shown in FIG. 2B where product support surfaces within the case are chilled and the product support surface at the top of the case may be heated (for example). By further way of example, such a display deck may take a form similar to that shown in FIG. 5A, 5B or 7A where an upper product support surface may be heated and a lower product support surface may be chilled.

It is also important to note that the construction and arrangement of the elements of the display deck for a temperature controlled case as shown schematically in the embodiments is illustrative only. Although only a few embodiments have been described in detail in this disclosure, those skilled in the art who review this disclosure will readily appreciate that many modifications are possible (e.g., angles and configurations of stepped portions of the deck, variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements, the operation of the heat transfer elements, cooling (or heating) system, frame member and product support surfaces may be reversed, reconfigured or otherwise varied, the length or width of the structures and/or members or connectors or other elements of the system may be varied, the nature or number of the product support surfaces may be varied (e.g. by variations in the number of product support surfaces or size and shape of the product support surfaces or type of engagement between the product support surfaces and the cooling system).

It should be noted that the elements and/or assemblies of the display deck for a temperature controlled case may be constructed from any of a wide variety of materials that provide sufficient strength or durability or heat transfer characteristics, in any of a wide variety of colors, textures and combinations. It should also be noted that the display deck for a temperature controlled case may be used in association with other refrigeration devices or in combination with multiple refrigerated preparation tables, or any of a wide variety of other equipment in other applications. Further, a wide variety of heat transfer fluids may be used in connection with the display deck for a temperature controlled case, and the cooling system may be configured to provide the flow of coolant to the product support surfaces in a series or a parallel flow path configuration, and the flow of coolant to the product support surfaces may be controlled for individual surfaces or group(s) of surfaces. Accordingly, all such modifications are intended to be included within the scope of the present inventions. Other substitutions, modifications, changes and omissions may be made in the design, operating conditions and arrangement of the preferred and other exemplary embodiments without departing from the spirit of the present inventions.

The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating configuration and arrangement of the preferred and other exemplary embodiments without departing from the spirit of the present inventions as expressed in the appended claims.

What is claimed is:

1. In a temperature controlled case defining a space for storage of products, including a cooling system configured to circulate a coolant to maintain a temperature of the products in the space, the improvement comprising a deck formed as a unitary member and disposed within the space, the deck having alternating planar segments and bent segments defining a stepped configuration to provide a plurality of product support surfaces configured to support the products and a first cooling element coupled to the deck and configured to receive a coolant from the cooling system so that a first one of the product support surfaces is configured to provide contact cooling to the products at a first temperature, and a second cooling element coupled to the deck and configured to receive coolant from the cooling system so that a second one of the product support surfaces is configured to provide contact cooling to the products at a second temperature;

wherein at least one of the bent segments comprise an aperture configured to permit drainage of liquids from the deck.

2. The temperature controlled case of claim 1 wherein at least a portion of the planar segments comprise the product support surfaces.

3. The temperature controlled case of claim 1 further comprising an applique applied to at least one of the planar surfaces.

4. The temperature controlled case of claim 1 wherein the cooling element comprises a coil coupled to a rear surface of the deck.

5. The temperature controlled case of claim 4 further comprising a conformable temperature conducting material interfacing at least partially between the coil and the rear surface.

6. The temperature controlled case of claim 1 wherein the cooling element comprises a plurality of cooling elements interconnected in a parallel flow arrangement.

7. The temperature controlled case of claim 1 wherein the cooling element comprises a plurality of cooling elements interconnected in a series flow arrangement.

8. The temperature controlled case of claim 1 further comprising an adjustment member configured for selectively positioning the deck in a plurality of product presentation positions.

9. An apparatus for the display of temperature controlled products, comprising: a case defining an enclosure, a sheet having a plurality of contiguous stepwise surfaces comprising alternating planar segments and bent segments, at least one of the bent segments including an aperture configured to permit drainage of fluids, a first cooling element integrated with one of the stepwise surfaces and a second cooling element integrated with another of the stepwise surfaces, the cooling elements configured to facilitate conductive heat transfer with the products, a cooling system configured to circulate a coolant to the cooling elements, and a control system configured to independently regulate a flow of coolant to each of the cooling elements to maintain a desired temperature of the products.

10. The apparatus of claim 9 wherein the case further comprises a top panel interfacing with a cooling element to provide a chilled platform for storage of products external to the enclosure.

11. The apparatus of claim 9 further comprising an applique applied to at least one of the stepwise surfaces.

12. The apparatus of claim 9 wherein the control system is configured to maintain the one of the stepwise surfaces at a first temperature and the other of the stepwise surfaces at a second temperature.

13. The apparatus of claim 9 wherein the cooling elements comprise a coil thermally coupled to a rearward side of the stepwise surfaces.

14. The apparatus of claim 9 wherein the cooling element comprises at least one generally hollow core portion extending through the sheet.

15. The apparatus of claim 9 wherein the stepwise surfaces are arranged to provide a series of ridges and valleys.

16. The temperature controlled case of claim 9 further comprising an adjustment member configured for selectively positioning the sheet in a plurality of product presentation positions.

* * * * *